US006779693B2

(12) United States Patent
Sweeton et al.

(10) Patent No.: US 6,779,693 B2
(45) Date of Patent: Aug. 24, 2004

(54) WEIGHTED DIP TUBE FOR A MANUAL DISPENSER

(75) Inventors: Steve L. Sweeton, Lee's Summit, MO (US); Joseph R. Krestine, Leawood, KS (US)

(73) Assignee: Saint-Gobain Calmar Inc., City of Industry ( * ) Notice: Subject to any disclaimer, the term of this patent is extended or adjusted under 35 U.S.C. 154(b) by 48 days.

(21) Appl. No.: 10/324,037

(22) Filed: Dec. 20, 2002

(65) Prior Publication Data

US 2004/0118876 A1 Jun. 24, 2004

(51) Int. Cl.[7] ..... B67D 5/60
(52) U.S. Cl. ..... 222/464.4; 222/382
(58) Field of Search ..... 222/382, 464.3, 222/464.4

(56) References Cited

U.S. PATENT DOCUMENTS 3,667,655 A 6/1972 Knieriem, Jr. ..... 222/464
5,125,534 A * 6/1992 Rose et al. ..... 222/54
5,529,216 A * 6/1996 Klima et al. ..... 222/130
5,839,620 A 11/1998 Battegazzore ..... 222/382
6,182,865 B1 2/2001 Bunschoten et al. ..... 222/136
6,290,100 B1 9/2001 Yacko et al. ..... 222/129

* cited by examiner

*Primary Examiner*—Kenneth Bomberg
*Assistant Examiner*—Melvin A. Cartagena
(74) *Attorney, Agent, or Firm*—Dykema Gossett PLLC

(57) ABSTRACT

A manually actuated dispenser having a flexible weighted dip tube is mounted to a container of liquid to be dispensed without entanglement by the dip tube by the provision of a tubular extension on the tube retainer which surrounds the tube and has a releasable holder for maintaining the tube in a collapsed condition during installation within the container, the retainer being dislodged or being soluble in the liquid in the container for releasing the stored dip tube permitting the ballast weight at its end to extend the tube toward the container bottom wall assuring a wetted condition of the inlet end of the tube during all attitudes of liquid dispensing.

8 Claims, 4 Drawing Sheets

WEIGHTED DIP TUBE FOR A MANUAL DISPENSER

BACKGROUND OF THE INVENTION

This invention relates generally to a manually operated pump sprayer mountable to a container of liquid to be sprayed, and more particularly to such a sprayer as having a weighted dip tube to ensure the emptying of substantially the entire contents of the container as the weight follows the bottom wall of the container during spraying. Also, the weight at the free end of the dip tube maintains the suction end of the dip tube wetted in the liquid irrespective of the attitude of the sprayer package during operation, i.e., upright, inverted, downwardly tilted, upwardly tilted.

There exists a wide variety of dispensers, both pump and squeeze bottles as well as nursing bottles, having wetted dip tubes for maintaining the suction end of the tube immersed in the liquid within the container irrespective of the container attitude during operation.

However, for weighted dip tubes to be effective for manually actuated pump sprayers and dispensers which are mounted to filled containers using today's high speed filling and assembly equipment, the weighted dip tube must be restrained to facilitate rapid installation. The flexible tubes which are weighted at their suction end would otherwise become entangled with the assembly equipment and would drastically slow down the operation.

There is therefore a need to better handle the weighted dip tubes to accommodate their rapid insertion into liquid filled containers with the use of high speed filling and assembly equipment.

SUMMARY OF THE INVENTION

It is therefore an object of the present invention to provide a manually actuated sprayer having a weighted dip tube which is initially stored in a retracted or collapsed condition such that upon the mounting of the dispenser to the container, the collapsed dip tube is automatically extended within the container, while at the same time utilizing a ballast weight of any shape and standard design.

In keeping with this objective, releasable means for holding the weighted dip tube in its collapsed condition without the need for a specially shaped or designed ballast weight is provided such that as the holder does not engage the ballast weight but rather underlies it or engages the flexible tube. Relatively sliding first and second members telescoped about the collapsed tube are provided for releasing the holder upon a mounting of the dispenser to the filled container whereupon the ballast weight extends the tube when released thereby avoiding any entanglement with high speed assembly equipment.

Otherwise, the holder may be soluble in the liquid to which the sprayer is mounted for releasing the ballast weight after mounting the dispenser to the filled container.

Other objects, advantages, and novel features of the invention will become more apparent from the following detailed description of the invention when taken in conjunction with the accompanying drawings.

DETAILED DESCRIPTION OF THE INVENTION

Figure 1:
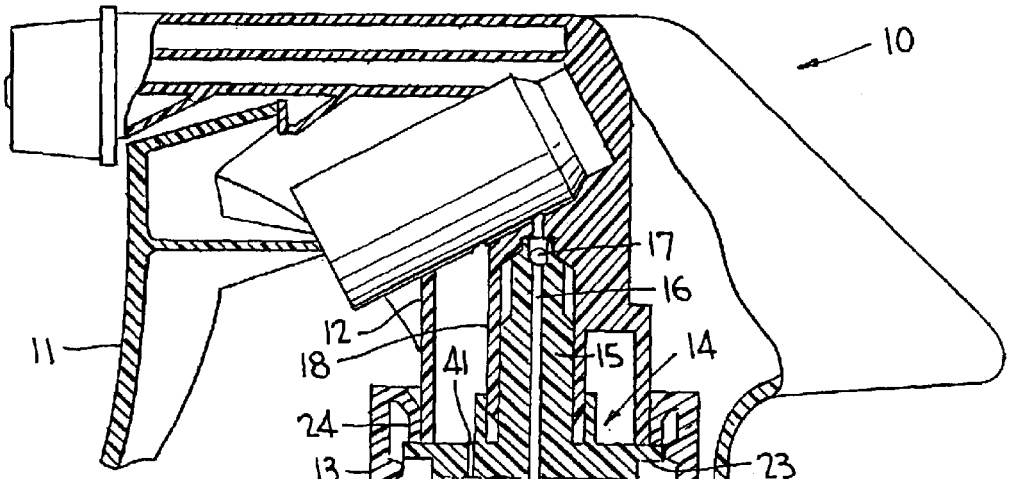
FIG. 1 is a vertical sectional view of a manual dispenser supporting a weighted flexible dip tube in a collapsed condition according to one embodiment of the invention.

Turning now to the drawings wherein like reference characters refer to like and corresponding parts throughout the several views, a manually operated dispenser is generally designated 10 in FIG. 1 adapted for carrying out the invention in accordance with one embodiment. The dispenser is shown as a manually actuated pump sprayer actuated by a trigger lever 11 for spraying product upon trigger actuation in a manner well known in this art. Manually dispensers other than pump dispensers are likewise adaptable to the invention, and manually actuated pump sprayers or dispensers for personal care which are typically finger actuated are likewise readily adaptable for the invention.

Dispenser body 12 has a container closure 13 coupled thereto of the type which is internally threaded for engaging the threads of the neck of a container C filled with the liquid to be dispensed. Coupled to the dispenser body is a tube retainer 14 having an upright barrel 15 defining an inlet passage 16 as typically valve controlled by a inlet ball check valve 17 supported at the upper end thereof. Barrel 15 may extend within a suitable cylinder 18 formed in the dispenser body for coupling the retainer frictionally thereto.

The tube retainer has an upper wall 19 with a depending nipple 21 to which the upper end of a weighted, extendable and retractable, flexible dip tube 22 is telescoped for securely mounting the dip tube to the tube retainer.

The tube retainer upper wall 19 has an annular flange 23 which bears against the lower end of the dispenser body when mounting the tube retainer in place, and which is coupled to container closure 13 via depending skirt 24 thereof.

Figure 2:
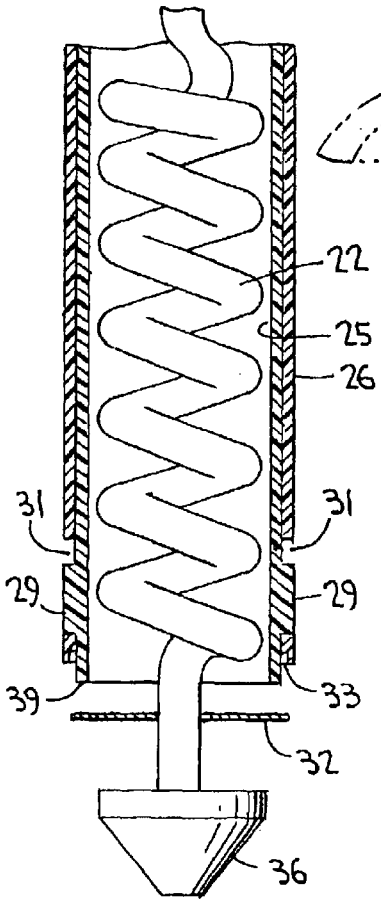
FIG. 2 a view similar to FIG. 1 showing the dip tube holder released for permitting the tube to extend from its collapsed condition.
Figure 2:
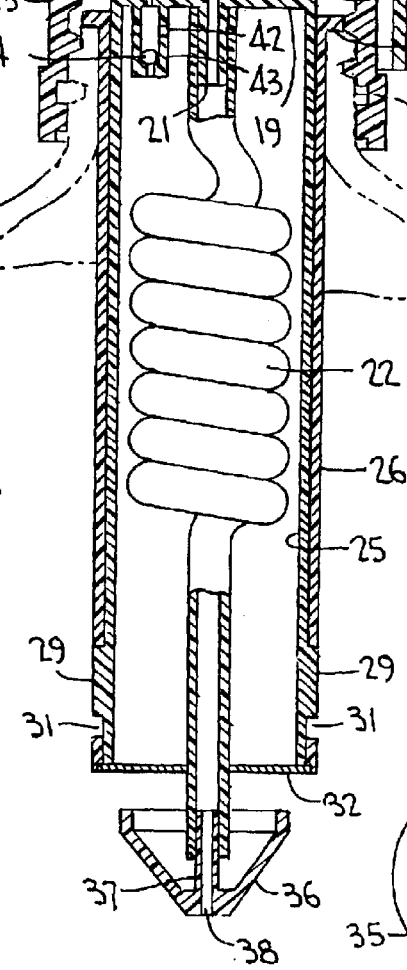

The tube retainer further includes a depending first member 25 which may be in the form of a tubular element surrounding the dip tube, a second member 26 which may be in the form of a tubular element being supported on the first member in a telescoping manner for axial sliding movement between first and second positions of FIGS. 1 and 2. Second member 26 likewise has an external annular flange 27 which overlies and bears against an upper free end of the neck 28 of the container C for purposes as will be described hereinafter.

First member 25 has one or more outwardly extending projections 29 extending into openings 31 located in second member 26, openings 31 being of increased size in a vertical direction relative to projections 29 so that together therewith limit stops are provided for limiting the extend of axial movement of second member 26 on first member 25.

Figure 1A:
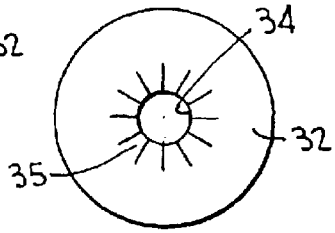

Releasable retainer means, which in the FIGS. 1, 2 embodiment may be in the form of a removable disc 32, fits within an open groove 33 at the free end of second member 26 (FIG. 2) so as to be thereby frictionally and releasably coupled to second member 26. Disc 32 has a central opening 34 which may be slightly undersized relative to the outer diameter of the dip tube so as to be frictionally engaged therewith. Otherwise, opening 34 could be formed by a plurality of spring legs 35 as shown in FIG. 1A to enhance gripping between the disc and dip tube.

A ballast weight 36 of some suitable type is connected to the free end of the dip tube by the provision of, for example, a tubular portion 37 of the ballast weight extending into frictional engagement with the dip tube, the tubular portion presenting a passage 38 which forms together with the dip tube and passage 16 an inlet path into the pump chamber (not shown) of the dispenser during pumping operation.

In the storage condition of the retracted dip tube which may as shown in FIG. 1 be coiled in its retracted condition, the lower free end 39 (FIG. 2) of first member 25 bears against the inner surface of disc 32 while the disc is frictional retained within groove 33 of second member 26, and flanges 23 and 27 of the first and second members are spaced apart as shown in FIG. 1 with the spacing limited by upper edges of openings 31 and projections 29.

In operation, the dispenser with its retracted dip tube (FIG. 1) is mounted to liquid filled container C typically by the supplier of that liquid product to be dispensed. Tubular members 25, 26, which are essentially rigid, are simply inserted into the container through its bottle neck utilizing available assembly equipment at the supplier's plant. The dip tube is sufficiently pliant and flexible to facilitate upright, downward, upward, and inverted dispensing, although no entanglement problems with the assembly equipment are encountered given the relative rigidity of tubes 25, 26 which surround the collapsed tube at the point of assembly to the bottle. In the FIGS. 1, 2 embodiment, ballast weight 36 extends outwardly of disc 32 such that the disc as aforedescribed frictionally engages the dip tube itself for retaining it in its FIG. 1 collapsed condition.

When the dispenser with its telescoping tubes 25, 26 is assembled to the container, flange 27 engages the upper edge of neck 28 of the container and is spaced apart a predetermined distance from flange 23 which is engaged by skirt 24 of closure 13. Then, as the closure 13 is torqued down over the bottle neck, the threads between the closure and the neck interengage to thereby close the gap between flanges 23 and 27 during the axial shifting of first member 25 relative to second member 26 to the position shown in FIG. 2. Such a relative shift between tubular members 25, 26 dislodges disc 32 from its seated position within open groove 33 such that retracted dip tube may now extend as it is uncoiled by the ballast weight falling under gravity within the container to the container bottom wall (not shown). In this process disc 32 remains connected to the dip tube so as not to interfere with the suctioning of liquid through the inlet passageway upon pumping operation. Typically, weight 36 will guide the inlet end of the tube in accordance with the attitude of the sprayer package during operation such that in all attitudes of upright, upward, downward, and inverted, the ballast weight will maintain the inlet end of the dip tube wetted in the liquid to assure dispensing universally in any attitude of the dispensing package. In order to avoid hydraulic lock and possible container collapse during dispensing, wall 19 of the tube retainer may be provided with a vent portion 41 which establishes communication between atmosphere and the container interior via openings 42 located in cage 43 provided for vent valve 44. In an inverted position of dispensing, the vent valve closes the vent port to prevent any possible leakage of product therethrough.

Figure 3:
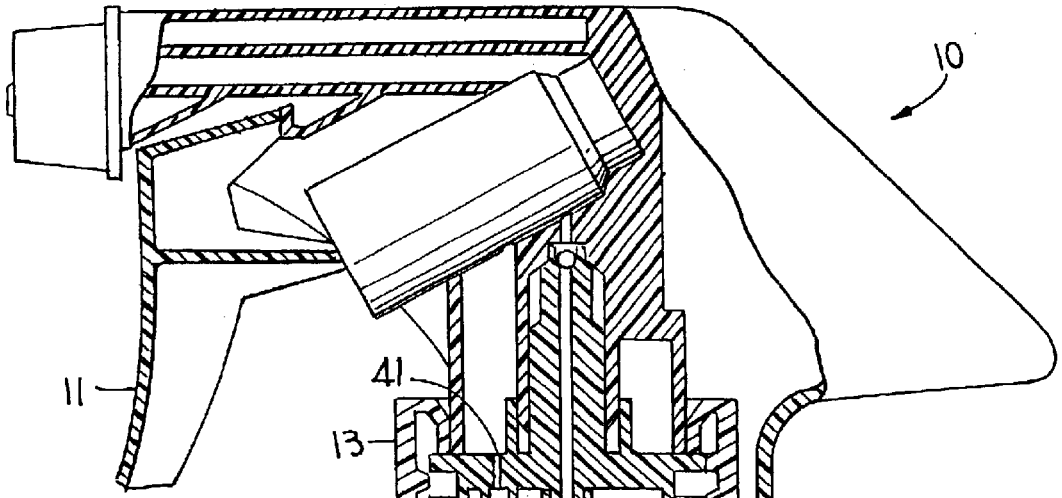
FIG. 3 is a view similar to FIG. 1 in accordance with another embodiment of the invention.
Figure 4:
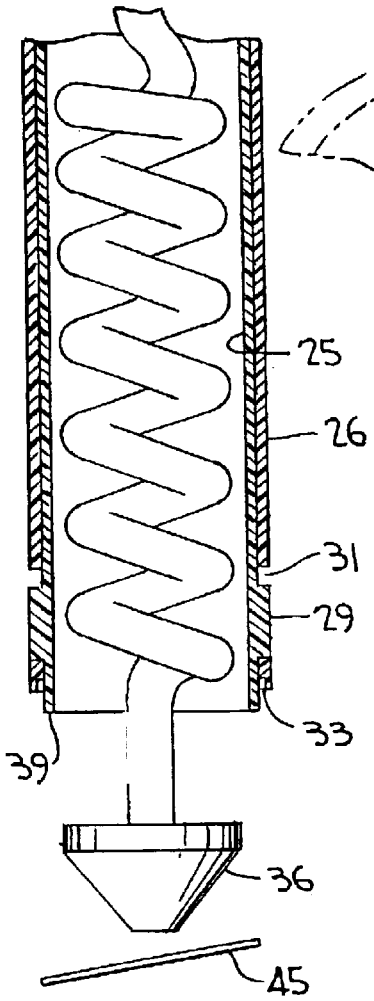
FIG. 4 is a view similar to FIG. 3 showing the flexible dip tube holder released permitting the dip tube to extend into the container.

The embodiment of FIGS. 3, 4 differs from that of FIGS. 1, 2 in that the releasable coil means comprising a holder element is in the form of a disc 45 which need not have an opening as in disc 32, which disc underlies ballast weight 36 for supporting the weight and thereby maintaining the coil in its retracted or coiled position of FIG. 3. As in the aforedescribed embodiment of FIGS. 1, 2, after the dispenser package is assembled to the container by extending tubular elements 25, 26 through the container neck opening to the position shown in FIG. 3, a torquing down of container closure 13 causes first member 25 to shift downwardly relative to second member 26 thereby unseating or dislodging disc 45 from groove 33 permitting the stored tube to extend into the bottle as guided by the falling ballast weight 36. The ballast weight functions in the same manner as described with reference to FIGS. 1, 2.

Figure 5:
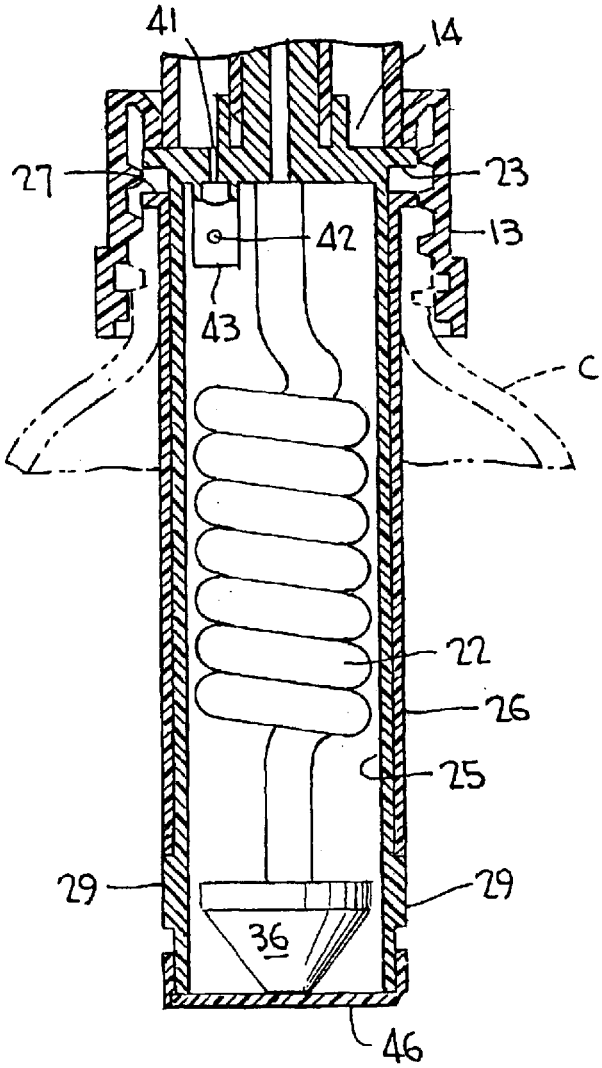
FIG. 5 is a view similar to FIG. 3 of yet another embodiment of the invention showing the flexible dip tube held in its collapsed condition.
Figure 6:
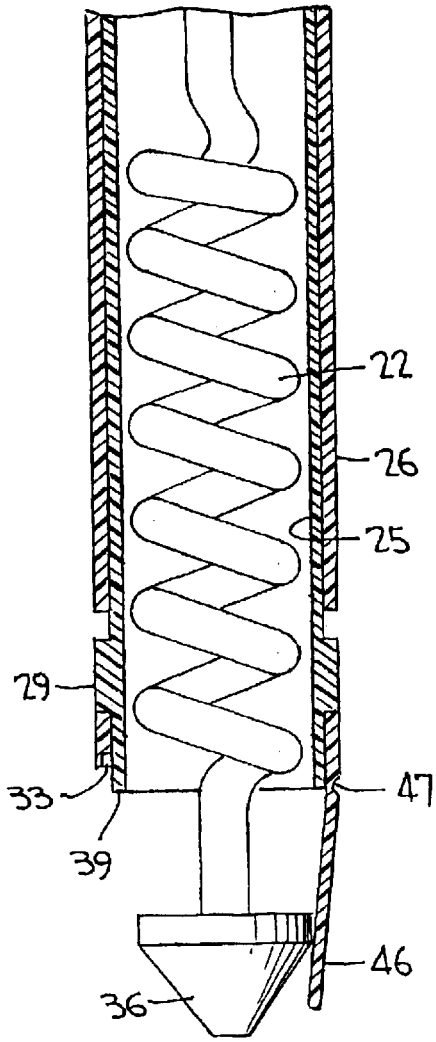
FIG. 6 is a view similar to FIG. 5 showing the holder released permitting the dip tube to extend.

In the FIGS. 5, 6 embodiment, the releasable dip tube means is in the form of a hinged panel 46 which may be hinged in some suitable manner to second member 26 as at 47 with its opposite end seated in open groove 33 at the distal end of second member 26. When the hinged panel is seated within that groove, it underlies and supports ballast 26 as shown in FIG. 5. On torquing down the closure 13 causing the first member 25 to shift downwardly relative to second member 26, as in the foregoing embodiments, edge 39 of member 25 applies a force against the inside of panel 46 causing it to unseat from groove 33 and to swing open to its position shown in FIG. 6 to thereby release the stored dip tube permitting it to extend outwardly and into the bottom of the container as guided by ballast weight 36 which assures that the inlet end of the tube be wetted irrespective of the attitude of the dispenser during use.

Figure 7:
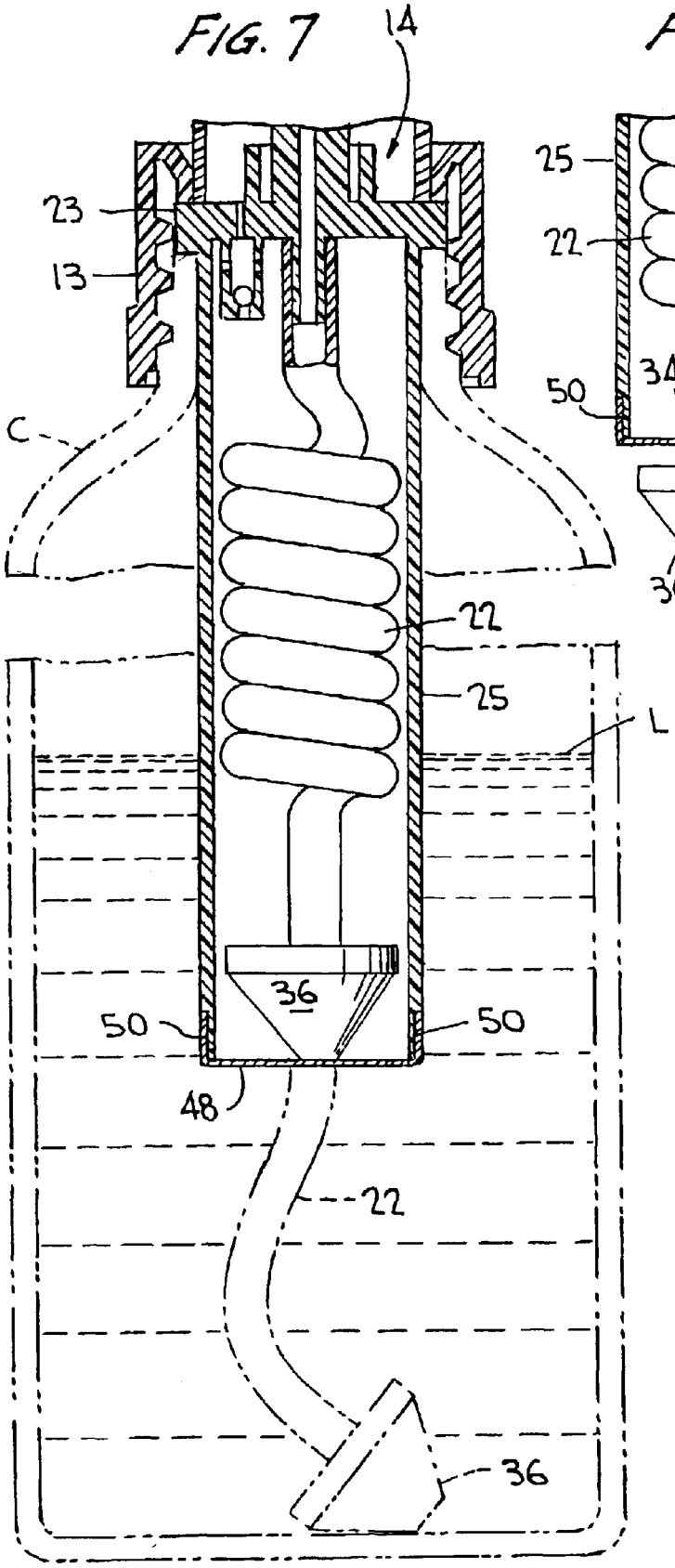
FIG. 7 is a view similar to FIG. 3 of yet another embodiment according to the invention in the form of a tube holder of soluble material.

In the FIG. 7 embodiment, second member 26 is eliminated, and first member 25 is connected to the tube retainer as in the aforedescribed embodiment. The means for releasably holding the collapsed dip tube within first member 25 until it is assembled into the container, is in the form of one or more plastic strips 48 which are connected in any normal manner to the distal end of first member 25 as by a heat seal or the like. The strip or strips 48 underlie ballast weight 36 for supporting the same and for maintaining the dip tube in its collapsed, stored condition shown in solid outline in FIG. 7. The plastic strip or strips 48 are soluble in the liquid contents L to be dispensed from the container. The plastics are typically compatible with the liquid on, contact so as not to interfere with the dispensing of the liquid by the manual dispenser. The soluble plastic material may be of any known form such as ethyl cellulose or methyl cellulose. And, the plastic strip or strips may be of the type which are not soluble in the liquid L, but rather the strips may be secured to the distal end of tubular member 25 utilizing soluble adhesive 50.

After a predetermined interval from mounting the dispenser assembly to the container with tubular member 25 extending through the container neck as essentially shown in solid outline in FIG. 7, strip or strips 48 dissolve in liquid L, or the sealant 50 holding the non-dissolvable strips to tubular member 25 dissolve in the liquid, thereby releasing the dip tube permitting the weight 36 to fall to the bottom of the container for extending the dip tube and for maintaining the suction end of the tube wetted in the liquid irrespective of the attitude of the dispenser during its operation.

Figure 8:
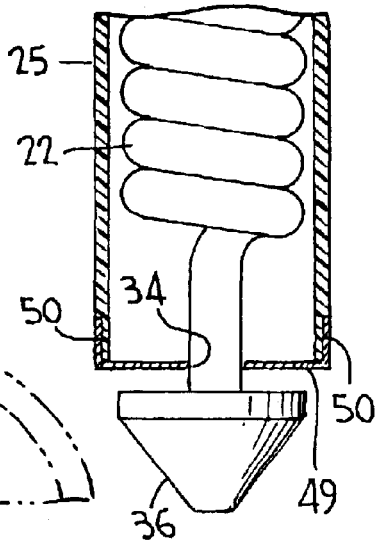
FIG. 8 is a view similar to FIG. 7 of still another embodiment according to the invention with the tube holder being of a soluble material.

The embodiment to FIG. 8 is similar to that of FIG. 7 except that the plastic strip or strips may be replaced by a plastic disc 49 or the like which is soluble in the liquid within the container and which is connected at the distal end of tubular member 25 by a heat seal or the like. Disc 49 has a central opening 34 similar to that of disc 32, or the opening may be defined by spring legs such as 35 for frictionally engaging dip tube 25 for retaining it in its collapsed condition while the ballast weight is situated externally of disc 49. Otherwise, the disc may be insoluble in the liquid and may be heat sealed in place using a soluble seal 50. As described with respect to FIG. 7, after a given interval of time following installation of the tubular member 25 within the container, retainer 49 itself dissolves or its sealer 50 dissolves thereby releasing the stored tube permitting the ballast weight to guide the inlet end of the tube and to maintain it in a wetted condition throughout dispensing at any attitude.

Obviously, many other modifications and variations of the present invention are made possible in the light of the above teachings. For example, first and second members 25, 26 need not be in the form of tubes so long as they are elongated and function for the purpose as described. Disc 32, 45, 49 need not be a solid disc but may a screen, and a disc can be utilized in place of plastic strip or strips 48, all without departing from the invention. Also, other than a disc or hinged panel or soluble element can be provided as a holder for maintaining the collapsed dip tube in it's stored position, pursuant to the invention. It is therefore to be understood that within the scope of the appended claims the invention may be practiced otherwise than as specifically described.

What is claimed is:

1. A manually operated dispenser comprising, a dispenser body having closure means for mounting the dispenser to a container of liquid to be dispensed, a dip tube retainer coaxial with the dispenser body and connected thereto, a weighted extendable and retractable, flexible dip tube connected to the tube retainer, a coaxial depending first member fixed to the tube retainer and surrounding the dip tube, a second member supported on said first member for axial sliding movement between first and second positions, and a releasable holder element releasably coupled to said second member retaining the dip tube in a retractable storage condition in the first position of the second member and permitting the dip tube to release from the retractable storage condition to an extended condition in the second position of the second member, the holder element being separate from and forming no part of the first member.

2. The dispenser according to claim 1, wherein said holder element comprises a disc in engagement with the dip tube and removably coupled to the second member.

3. The dispenser according to claim 1, wherein said holder element comprises a disc underlying a weight at a free end of the dip tube and being removably coupled to the second member.

4. The dispenser according to claim 1, wherein said holder element comprises a trap door hinged to the second member and underlying a weight at a free end of the dip tube.

5. The dispenser according to claim 1, wherein the first and second members comprises telescoping tubular elements with the axial sliding movement effected upon a mounting of the dispenser on to the container.

6. A manually operated dispenser comprising, a dispenser body having closure means for mounting the dispenser to a container of liquid to be dispensed, a dip tube retainer coaxial with the dispenser body and being connected thereto, a weighted, extendable and retractable, flexible dip tube connected to the tube retainer, a coaxial member fixed to the tube retainer and surrounding the dip tube, releasable means on said member retaining the dip tube in a retractable storage condition within the coaxial member and releasing the dip tube from the retractable storage position to an extendable position, said releasable means comprising a holder element separate from and forming no part of the tube retainer and soluble in the liquid to be dispensed from the container.

7. The dispenser according to claim 6, wherein the soluble holder element underlies a weight at a free end of the dip tube.

8. The dispenser according to claim 6, wherein the soluble holder element engages the flexible tube.

* * * * *